United States Patent [19]

Scheel

[11] Patent Number: 4,527,776

[45] Date of Patent: Jul. 9, 1985

[54] METHOD OF CONTROLLING SUBSTANTIALLY EQUAL DISTRIBUTION OF PARTICULATES FROM A MULTI-OUTLET DISTRIBUTOR AND AN ARTICLE CONSTRUCTED ACCORDING TO THE METHOD

[75] Inventor: John H. Scheel, Ashland, Ky.

[73] Assignee: Armco, Inc., Middletown, Ohio

[21] Appl. No.: 563,192

[22] Filed: Dec. 19, 1983

[51] Int. Cl.[3] ..... B56G 53/34

[52] U.S. Cl. ..... 266/44; 266/182

[58] Field of Search ..... 266/44, 182; 406/181, 406/182, 183

[56] References Cited

U.S. PATENT DOCUMENTS

| | | | |
|---|---|---|---|
| 2,734,782 | 2/1956 | Galle | 266/182 |
| 3,204,942 | 9/1965 | Matthys et al. | 266/182 |
| 3,858,640 | 1/1975 | Sifferlen | 266/182 |
| 4,027,920 | 6/1977 | Wennerstrom | 266/182 |

*Primary Examiner*—L. Dewayne Rutledge
*Assistant Examiner*—S. Kastler
*Attorney, Agent, or Firm*—Shlesinger, Arkwright, Garvey & Fado

[57] ABSTRACT

A method for controlling substantially equal distribution of particulates from a multi-outlet distributor in a conveying system conveying a supply of particulates to at least a first receiver is disclosed wherein a relationship between the velocity of the moving particles and the internal diameter and the heighth above a cone in the distributor is utilized to control distributor deviation.

9 Claims, 3 Drawing Figures

METHOD OF CONTROLLING SUBSTANTIALLY EQUAL DISTRIBUTION OF PARTICULATES FROM A MULTI-OUTLET DISTRIBUTOR AND AN ARTICLE CONSTRUCTED ACCORDING TO THE METHOD

BACKGROUND OF THE INVENTION

The substitution of pulverized coal for coke in an iron-making blast furnace is well known in the art. Efficient operation of the blast furnace requires that the coal be uniformly distributed in the furnace to prevent channeling of the blast air, as well as other problems. The coal is, normally, injected into the tuyeres which communicate with the furnace. The tuyeres are also used for supplying the high temperature blast air which supports the iron-making reduction of the ore. The tuyeres are generally arranged equiangularly circumferentially around the furnace above the hearth and, consequently, the injected coal is similarly injected at equiangularly located positions around the furnace.

The coal which is injected into the furnace through the tuyeres is, generally, finely ground or pulverized and has a very low, on the order of about 0.5%, moisture. Due to the fine grind of the coal, it is generally transported to the tuyeres by means of a pneumatic system conveying the coal through a system of pipes from the coal preparation facility to the blast furnace. In order to simplify the numbers and the complexity of the pipe system, it is preferred that the ground coal be transported to a coal distributor located adjacent the furnace. The coal distributor preferably provides a suitable number of outlets communicating with the tuyeres. Ideally, the coal distributor should be constructed so that each of the lines feeding a tuyere receives an air/-coal suspension of a quantity substantially equal to the amount received by the other lines feeding the other tuyeres. In this way, uniform distribution of the pulverized coal in the furnace can be assured with the result that efficient operation of the blast furnace can be maintained.

Matthys, et al, U.S. Pat. No. 3,204,942, discloses a distributor for pneumatically transporting particulate material, preferably coal. Matthys discloses an upstanding cylinder having a centrally located inlet coal/air supply line and a plurality of equiangularly disposed outlets positioned on a common horizontal plane. The distributor of Matthys discloses an inverted cone disposed in the bottom of the cylinder and having a downwardly diminishing diameter in order to prevent coal accumulation. Experience has shown, however, that the Matthys distributor results in unequal distribution of the coal/air suspension to the lines communicating with the tuyeres. Consequently, the Matthys distributor is not capable of providing sufficient uniformity of coal distribution which would permit greater efficiency in the operation of the blast furnace. While Matthys discloses that flow restrictors may be placed in the lines to effect equality of pressure drop, the actual use of such restrictors has proven to be extremly complicated and that the insertion of one restrictor has an effect on other lines in the system.

Wennerstrom, U.S. Pat. No. 4,027,920, discloses a distributor similar to Matthys' and in which a hollow cylinder is suspended in the distributor aligned with the central opening in order to maintain central orientation of the oncoming stream. Wennerstrom, the assignee of which is also the assignee of the Matthys patent, in commenting on the Matthys patent states "Recent experience has shown the deviation of the incoming stream from its central orientation results in pulsation and non-uniform distribution of the effluent streams." Consequently, there is an appreciation in Wennerstrom by the owner of the Matthys' patent that the Matthys' distributor does not provide optimum distribution to each of the tuyeres. Unfortunately, experience has also shown that the Wennerstrom solution to the Matthys problem results in a similarly non-uniform distribution to each of the tuyere lines.

The present invention discloses a method for controlling the substantially uniform distribution of the coal-/air suspension from a multi-outlet distributor which is in communication with the tuyeres of a blast furnace. The method of the invention permits the blast furnace operator to select that level of distributor deviation which can either be tolerated by the blast furnace or which is the best obtainable in view of practical physical limitations. The present method permits a blast furnace operator to contstruct a distributor bottle taking into account the velocity of the coal particles and the diameter of the bottle as well as the distance from the top plane of the cone to a plane coincident with the central axes of the outlet tuyere pipes. Consequently, the present method permits the construction of a distributor bottle in which the distributor deviation may be controlled from zero deviation to that amount of deviation which the furnace operator is willing to tolerate. The present method provides, therefore, a novel and unique means for controlling the distribution of coal to a blast furnace in order to premit optimum efficient operation of the furnace.

OBJECTS OF THE INVENTION

It is a primary object of the disclosed invention to provide a method for overcoming the above-noted disadvantages and problems of prior art distributors.

It is an additional object of the disclosed invention to provide a system which permits the furnace operator to control the deviation from the mean of the coal injected into a blast furnace.

It is a further object of the disclosed invention to provide a means for providing a distributor constructed so as to have the optimum dimensions for attaining the preselected distributor deviation.

Yet another object of the disclosed invention is to provide a means for providing a distributor which has the minimum volume necessary for attaining the preselected deviation level.

Still a further object of the disclosed invention is to provide a means for providing a distributor bottle the size of which may deviate from the optimum size yet which will still attain the pre-selected deviation level.

Yet still a further object of the disclosed invention is to provide a distributor bottle having dimensions sufficient to attain the pre-selected deviation level after the velocity of the particle-moving gas stream has been selected.

Yet still a further object of the disclosed invention is to provide a distributor bottle which is capable of attaining substantially uniform distribution of particulates from a multi-outlet distributor.

These and other objects and advantages and novel features of the present invention will be readily apparent in view of the following description and drawings of the above-described invention.

DESCRIPTION OF THE DRAWINGS

The above and other objects and advantages and novel features of the present invention will become apparent from the following detailed description of the preferred embodiment of the invention illustrated in the accompanying drawings, wherein.

DESCRIPTION OF THE INVENTION

Figure 1:
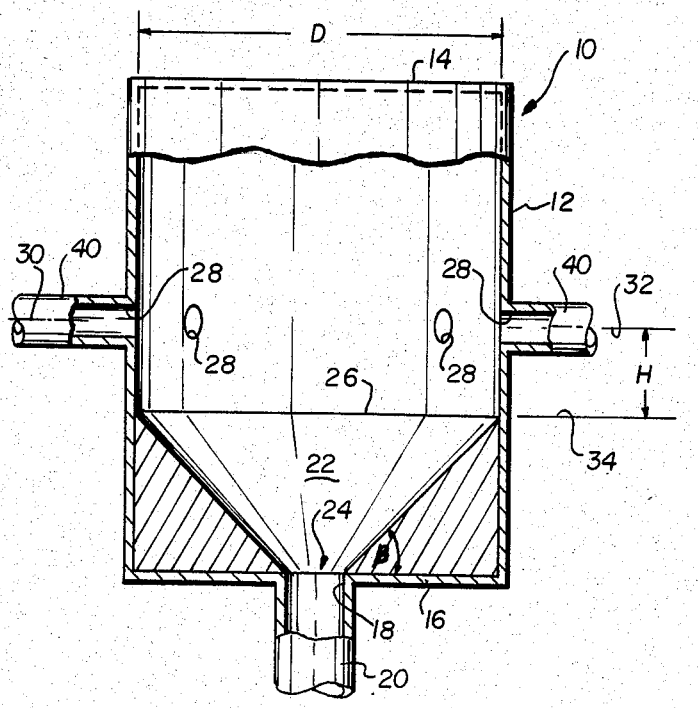
FIG. 1 is a side elevational view, with portions broken away, showing the distributor bottle of the method.

A particulate distributor or distributor bottle 10, as best shown in FIG. 1, includes a generally vertically disposed right cylinder 12. Cylinder 12 is closed at its top 14 and its bottom 16. Bottom 16 includes a central opening or aperture 18 which is connected to a particulate supply line 20. An inverted right circular conical insert 22 is disposed in cylinder 12 adjacent bottom 16 and includes an opening 24 aligned with opening 18 in bottom 16. The opening 24 of conical insert 22 opens gradually outwardly as the distance from bottom 16 increases and, therefore, yields the conical slope of insert 22. Insert 22 has a top 26 which represents a horizontally disposed plane which is parallel to bottom 16.

Cylinder 12 includes a plurality of openings or outlets 28, four of which are shown in FIG. 1, although a greater or fewer number may be employed as circumstances warrant, and which are disposed equiangularly around cylinder 12, although equiangularly positioning is not necessary for functioning of the invention. Each of the outlets 28 is horizontally disposed such that a longitudinal centrally disposed axis, such as axis 30, is coincident with a horizontal plane 32 passing through each of the axes 30. The plane 32 coincident with the axes 30 is generally horizontally disposed and is parallel to the plane 34 aligned with the top 26 of conical insert 22.

Figure 2:
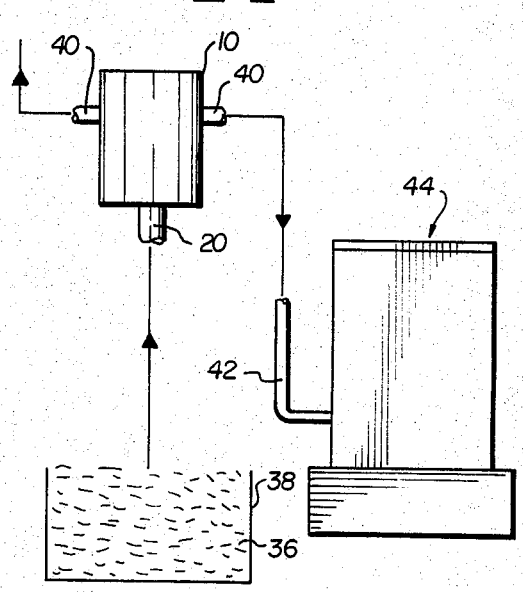
FIG. 2 is a schematic view of the distributor bottle of the system in communication with a supply of particulates and a blast furnace.

As best shown in FIG. 2, distributor bottle 10 is in communication with particulates 36, which preferably includes coal particles which are ground so that 80% or more of the particles are less than 200 mesh, and are contained in a coal preparation receiver 38. Inlet supply line 20 is in fluid communication with coal receiver 38 and acts to pneumatically convey the coal particles 36 to distributor 10. Preferably, the coal particles 36 have been dried so that the moisture of the particles 36 does not exceed 0.5%. The coal particles 36 are preferably maintained at a temperature of between 120° F. to 150° F. in order to prevent volatilization of the particles 36 in order to prevent, therefore, the eventual plugging of supply line 20. The coal particles 36 are pneumatically conveyed along supply line 20 by dried heated air, whose temperature does not exceed 150° F.

Distributor 10 includes a plurality of tuyere outlet supply lines 40 which are coaxially aligned with and have a diameter at least equal to the diameter of openings 28. Tuyere outlet supply lines 40 are in fluid communication with tuyeres 42 which feed blast furnace 44, in a manner well known in the art. Although only one of tuyere outlet supply lines 40 is shown in communication with a tuyere 42, one skilled in the art will appreciate that a plurality of tuyeres 42 are circumferentially arranged about furnace 44 and that each tuyere 42 is in communication with one of tuyere outlet supply lines 40. In this way, coal particulates 36 in receiver 38 may be pneumatically conveyed through supply line 20 to distributor 10 and hence along tuyere outlet supply lines 40 to tuyeres 42 and ultimately injected along with the blast air into the blast furnace 44.

Matthys, U.S. Pat. No. 3,204,942, describes how the coal particulates 36 move upwardly through opening 18 and mushroom along top 14 and ultimately distribute through outlets 28 and tuyere outlet supply lines 40 and, further elucidation on the operation of the distributor 10 is not necessary.

In order to efficiently operate a blast furnace, such as blast furnace 44, it is necessary that the wind rate, that is the amount of hot blast air injected into the furnace, be known. Additionally, the length of the run of each of the tuyere outlet supply lines 40, as well as the number of tuyeres and the top pressure of the furnace 44 must be known. Once these values have been determined, the available oxygen per tuyere is determined and it is the available oxygen per tuyere which determines the maximum coal flow rate to each tuyere. One skilled in the art will appreciate that coal is an amorphous mixture of a number of carbon containing molecules and that it is the combustion of these molecules which help to heat the furnace. There are many and various grades of coal, each with its own particular volatility and free carbon available for combustion, and the present invention is not limited to any particular type or grade of coal. After the amount of coal to be fed to each tuyere has been determined, the line size, or the internal diameter, of the tuyere outlet supply lines 40 can be determined. Preferably, the tuyere outlet supply lines 40 have an internal diameter ranging from approximately $\frac{3}{4}$ inches to approximately 2 inches.

Calculation of the size of the tuyere outlet supply lines 40 may be accomplished in a manner which is well known to one skilled in the art. It is necessary, however, that the velocity of the moving air/coal suspension be maintained at least equal to, and preferably slightly greater than, the saltation velocity of the mixture. The saltation velocity is that velocity at which none of the entrained particulates 36 will settle out or separate from the air/particulate suspension. The saltation velocity is a function of the line size, the density of the mixture and the velocity of the conveying fluid, as is well known in the art.

One skilled in the art will appreciate that because the coal particulates 36 are ground to a size such that 80% or more will pass through a 200 mesh sieve, the particulates 36 are extremely small. Due to the extremely small size of the particulate 36, they behave essentially, as part of the gas stream. Consequently, the total gas flow through the tuyeres is the sum of the gas flow, which is preferably dried, heated air, through the tuyeres plus the particulates entrained in the flowing gas/coal suspension. Consequently, the size of the distributor 10 is not directly proportional to the quantity of coal 36 being injected into the furnace 44.

After the total gas flow and the saltation velocity have been determined, sizing of the distributor 10 may proceed in a relatively straightforward manner, as will hereafter be explained. The furnace operator (not shown) may either decide to select that size bottle which will provide the optimum, that is equal, distirbution to each of the outlet supply lines 40 or, due to physical plant limitations, may select that distributor 10 which provides a distributor deviation which is acceptable and a bottle size which may be utilized. Distributor deviation or DMAX equals that amount expressed as a percentage by which the flow through a tuyere exceeds or is less than the mean flow available for each of the tuyeres. Consequently, DMAX is the maximum deviation and represents that tuyere through which the greatest or the least amount of coal/air suspension passes. The mean flow rate through each of the outlet supply lines 40 is merly the total flow rate divided by the number of outlet supply lines 40.

The following equation permits the furnace operator to determine the optimum sizing for the distributor 10 taking into account DMAX. The equation is a function of the distance from the outlet center lines 32 to the top of the conical section 34, as designated H in FIG. 1 and with H expressed in inches. The equation is also a function of the internal diameter D of the distributor 10, as best shown in FIG. 1, with the internal diameter D expressed in inches. Finally, the equation is a function of the gas velocity V of the moving air/coal suspension with the velocity expressed in feet per seconds.

The equation for calculating the size of the distribution 10 or permitting the optimization of the distributor deviation is:

$$\text{DMAX} = a_0 + a_1X + a_2Y + a_3Z + a_4XY + a_5XZ + a_6YZ + a_7X^2 + a_8Y^2 + a_9Z^2$$

Where $a_0 = 0.123519$
$a_1 = 0.012624$
$a_2 = -0.056494$
$a_3 = 0.001738145$
$a_4 = -0.024970$
$a_5 = 0.008364605$
$a_6 = 0.009806324$
$a_8 = 0.023791$
$a_9 = 0.018989$ and $X = \frac{H - 19.125\text{ (in)}}{18.0\text{ (in)}}$ $H$ = distance from outlet centerline to top of conical section (in.)

$Y = \frac{D - 17.25\text{ (in.)}}{6.0\text{ (in.)}}$ $D$ = bottle diameter (in.)

$Z = \frac{V - 80\text{ (fps)}}{20\text{ (fps)}}$ $V$ = gas velocity (fps)

The V used for calculating the Z to be applied in the equation for DMAX must be at least equal to the saltation velocity.

One skilled in the art will appreciate that X, Y and Z are all dimensionless numbers and therefore they permit universal application of the equation for DMAX with the effect that that equation can be applied to any right cylindrical distributor 10, as above described.

In order to obtain the optimally sized distributor 10 having the minimum value for DMAX, then calculation of Z permits one skilled in the art to determine X and Y by means of differential equations as is well known in the art. The volume of the bottle 10 may then be calculated according to the equation:

$$Vo = \frac{\pi D^2}{41472}\,[72 + 6H + \sqrt{3}\,(D - 3)]$$

This equation for the volume of the distributor 10 is applicable when the angle beta, as best shown in FIG. 1, is equal to 60°. The equation may be adjusted depending on the angle Beta. It can be appreciated from the above, that the calculation of the optimum or minimum DMAX results in a minimum volume Vo for the distributor 10 for the DMAX value.

Due to physical plant limitations, the furnace operator may not be capable of utilizing a distributor 10 having the minimum DMAX attainable due to size considerations of the bottle. The furnace operator may, however, also not require the minimum deviation from the mean distribution with the result that a differently sized distributor 10 may be effectively utilized. One skilled in the art will appreciate that the equation for DMAX results in an infinite number of values for D and H for any given DMAX in excess of the minimum DMAX value, for a constant velocity V.

Figure 3:
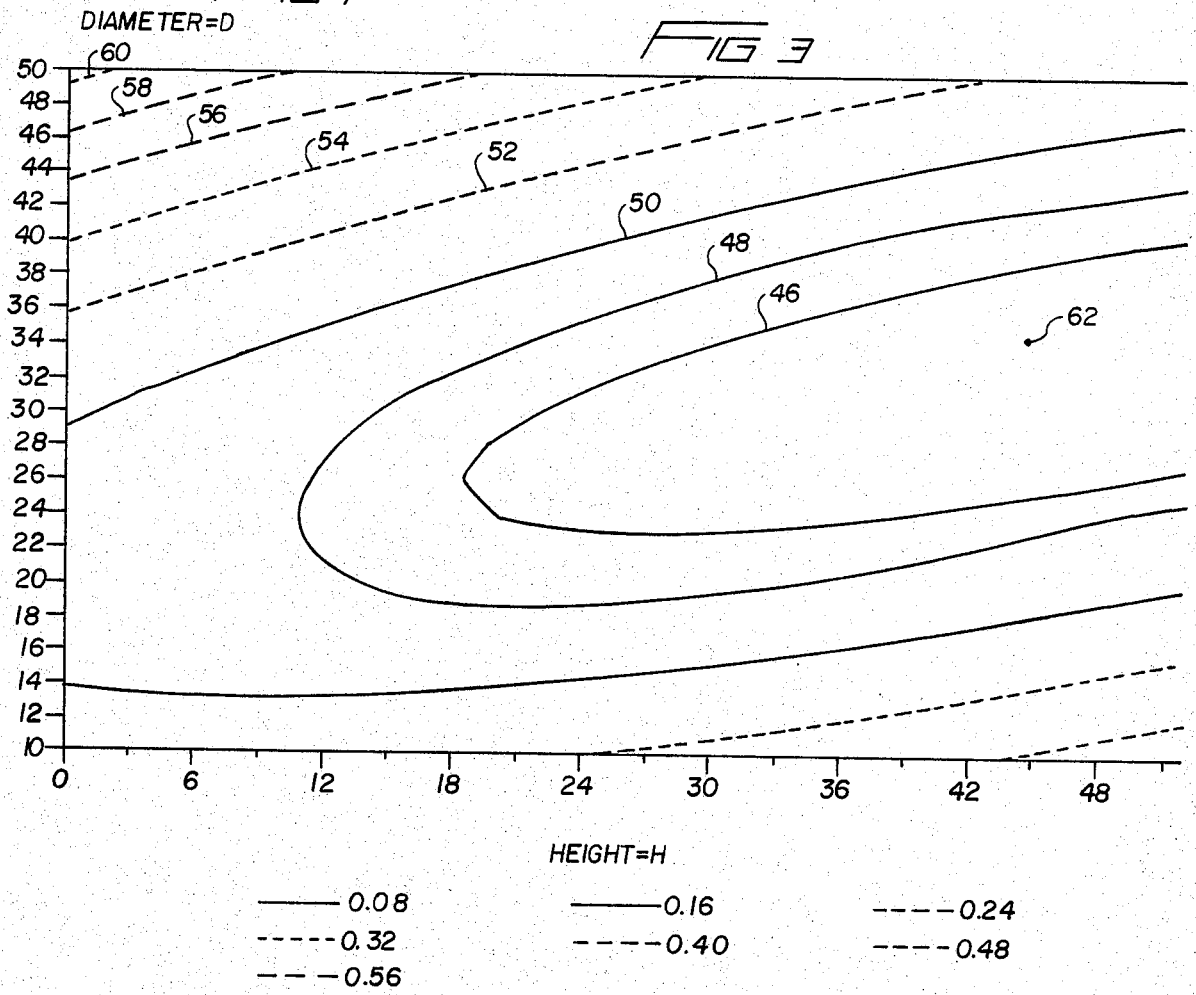
FIG. 3 is a graph of the diameter D of the distributor versus the height H above the cone to a plane coincident with the distributor outlets and disclosing the iso-distribution lines resulting from use of the equation for deriving the dimensions of the distributor.

FIG. 3 discloses isodistribution lines 46, 48, 50, 52, 54, 56, 58 and 60 calculated for one distributor 10 with V=75 fps. It will be appreciated that the isodistribution lines each represent a curve which at any point on the curve will yield an equal value for DMAX. The legend associated with the isodistribution lines 46–60 is given below FIG. 3.

The minimum DMAX 62, as shown in FIG. 3, may result in a distributor 10 which is too large to be accommodated by the furnace operator. Should the furnace operator feel that a DMAX equal to 8%, as best shown by isodistribution line 46, is sufficient, then by appropriately selecting values for D and H along isodistribution line 46 the furnace operator may choose a bottle 10 which may be utilized in his situation. Similarly, the furnace operator may utilize any of other isodistribution lines 48–60 where situations warrant. It should also be appreciated that in FIG. 3 only a limited number of isodistribution lines 46–60 have been shown but that an infinite number could have been derived depending upon the levels of DMAX chosen.

One skilled in the art will appreciate that it is possible to minimize DMAX as a function of X, Y and Z with the result that the minimized value for DMAX may not be equal to zero but may exceed a threshold level. In one study, DMAX was minimized and equaled 3.51% with a gas velocity V equal to 50.12 feet per second with a diameter D equal to 38.39 inches and a height H equal to 62.78 inches. The results obtained were, however, not physically possible as the saltation velocity for the coal/air suspension was approximately 60.0 feet per second with a consequence that the gas velocity V was not sufficient for maintaining the ground coal entrained in the mixture. Consequently, the results obtained whenever the equation for DMAX is utilized must be physically correlated in order to prevent non-physical sizing of the distributor 10.

In a working embodiment of the system, the saltation velocity or V was determined to be 75 feet per second. DMAX was then minimized and resulted in a height H equal to 46.4 inches and a diameter D equal to 32.6 inches and the value of DMAX was equal to 5.18%. Consequently, for the velocity chosen the minimum deviation from the mean could only be controlled to 5.18%. Consequently, a gas flow velocity of 75 feet per second with a minimum DMAX value of 5.18% represents the optimum control available for that given velocity. Other control levels, as shown by the isodistribution lines 46–60 in FIG. 3, were also attainable for the gas flow velocity V equal 75 feet per second and, consequently, infinite control over DMAX and the diameter D and the height H of the distributor 10 is attainable by means of use of the equation for DMAX.

While this invention has been described as having a preferred design, it is understood that it is capable of further modifications, uses and/or adaptations of the invention following in general the principle of the invention and including such departures from the present disclosure as come within know or customary practice in the art to which the invention pertains, and as may be applied to the essential features hereinbefore set forth, and fall within the scope of the invention of the limits of the appended claims.

What I claim is:

1. The method of controlling substantially equal distribution of particulates from a multioutlet distributor in a conveying system conveying a supply of particulates to at least a first receiver having a plurality of inlets for conveying pulverized coal or the like to a blast furnace having a plurality of inlets, comprising the steps of:

(a) providing a quantity of particulates to be conveyed through said system;

(b) providing a moving fluid for conveying said particulates through said system, said fluid having a velocity at least equal to the saltation velocity;

(c) selecting a distributor deviation of from about 0% to less than 4%;

(d) providing a single distributor having a chamber permitting unchanneled flow of particulates and having a plurality of generally equiangularly disposed outlets wherein said distributor is sized according to the equation:

$$\text{Distributor deviation} = 0.123519 + 0.012624\,X - 0.056494\,Y + 0.001738145\,Z - 0.024970\,XY + 0.008364605\,XZ + 0.09806324\,YZ + 0.015736\,X^2 + 0.023791\,Y^2 + 0.018989\,Z^2, \text{ where } X = \frac{H - 19.125}{18},$$

$$Y = \frac{D - 17.25}{6.0}, \text{ and } Z = \frac{V - 80}{20}$$

And where H is the distance between said distributor outlets and the top of an insert in said distributor, D is the internal diameter of said distributor and V is the velocity of said moving fluid;

(e) connecting each of said outlets with one of said inlets of said at least first receiver; and, (f) operating said system.

2. The method of claim 1, further including the step of:

(a) minimizing said distributor volume, said distributor having a volume according to the equation;

$$V_o = \frac{\pi D^2}{41472}\,[72 + 6\,H = \sqrt{3}\,(D - 3)].$$

3. The method of claim 1, including:

(a) minimizing said fluid velocity so as to be no more than equal to said saltation velocity.

4. The method of claim 1, including:

(a) providing particulates having a moisture of substantially 0.5%.

5. The method of claim 1, including:

(a) providing particulates of a size such that at least 80% of said particulates are of a size less than 200 mesh.

6. The method of claim 1, including:

(a) maintaining said particulates at a temperature less than 150° F.

7. The method of claim 1, including:

(a) providing duct means for conveying said particulates from said distributor to said at least a first receiver, said duct means having an internal diameter of about $\frac{3}{4}$ inch to about 2 inches.

8. The method of claim 1, including:

(a) minimizing said distributor deviation.

9. A bottle distributor providing substantially equal distribution of particulates to a multiinlet receiver wherein the velocity of the particulates is at least equal to the saltation velocity and particularly for conveying pulverized coal or the like to a blast furnace having a plurality of inlets, comprising;

(a) a longitudinally extending right hollow cylinder closed at the upper and lower ends thereof;

(b) a centrally disposed particulate inlet in said lower end permitting particulates to enter the interior of said cylinder and wherein said cylinder permits unchanneled flow of particulates;

(c) a conical insert contiguous with said lower end having a central opening aligned with said inlet and a surface extending angularly therefrom to the wall of said cylinder;

(d) a plurality of generally equiangularly disposed outlets intermediate said upper and lower ends and each of said outlets connected with an inlet of said receiver for thereby permitting particulates to be conveyed from said cylinder to said receiver; and, (e) said distributor having a preselected distributor deviation of from about 0% to less than 4% and said distributor being sized according to the equation:

$$\text{Distributor deviation} = 0.123519 + 0.012624\,X - 0.056494\,Y + 0.001738145\,Z - 0.024970\,XY + 0.008364605\,XZ + 0.09806324\,YZ + 0.015736\,X^2 + 0.023791\,Y^2 + 0.018989\,Z^2, \text{ where } X = \frac{H - 19.125}{18},$$

$$Y = \frac{D - 17.25}{6.0}, \text{ and } Z = \frac{V - 80}{20}$$

And where H is the distance between said distributor outlets and the top of an insert in said distributor, D is the internal diameter of said distributor and V is the velocity of said moving fluid.

* * * * *